US006089243A

United States Patent [19]

Hörger et al.

[11] Patent Number: 6,089,243

[45] Date of Patent: Jul. 18, 2000

[54] HYDRODYNAMIC TOOL FOR CLEANING PIPES AND CHANNELS

[76] Inventors: Kurt Hörger, Kleiststrasse 13, 09130 Chemnitz; Hans Lutze, Am Karbel 25, 09116 Chemnitz, both of Germany

[21] Appl. No.: 09/111,697

[22] Filed: Jul. 8, 1998

Related U.S. Application Data

[63] Continuation-in-part of application No. PCT/DE96/02153, Nov. 8, 1996.

[51] Int. Cl.[7] ..... B08B 3/02

[52] U.S. Cl. ..... 134/167 C; 134/168 C; 134/169 C

[58] Field of Search ..... 134/168, 166, 134/167 C, 169 C; 15/104.12, 104.31

[56] References Cited

U.S. PATENT DOCUMENTS

| | | | |
|---|---|---|---|
| 3,656,694 | 4/1972 | Kirschke | 239/533 |
| 4,107,738 | 8/1978 | Van Norman | 358/100 |
| 4,756,324 | 7/1988 | Larsson | 134/167 C |
| 5,203,646 | 4/1993 | Landsberger | 405/191 |
| 5,435,854 | 7/1995 | Derlein | 134/22.11 |

FOREIGN PATENT DOCUMENTS

| | | |
|---|---|---|
| 3237583 | 4/1984 | Germany . |
| 3502916 | 7/1986 | Germany . |
| 9214268 | 4/1993 | Germany . |
| 9308910 | 1/1994 | Germany . |
| 19516780 | 8/1996 | Germany . |
| 8505295 | 12/1985 | WIPO . |

*Primary Examiner*—Frankie L. Stinson
*Assistant Examiner*—Mialeeka C. Williams-Bibbs
*Attorney, Agent, or Firm*—Horst M. Kasper

[57] ABSTRACT

A hydrodynamic tool for the cleaning of pipes and channels exhibits a pressurized water-entry inlet opening (2) connected to pressurized water-discharge outlet openings (4) through water guide channels (3). The water guide channels (3) are continuously connected to the pressurized water-entry inlet opening (2) with a hose connection (2*a*). The water guide channels (3) exhibit a largest possible deflection radius (r) and partially converge into one another. At least two water guide channels (3) rest with the innermost point of the diameter ($d_{W1}$) at the center point (M) and with their outermost point of the diameter ($d_{W1}$) at the outer diameter ($d_E$) of the pressurized water-entry inlet opening (2). The water guide channels (3), corresponding to the arrangement of the pressurized water-discharge outlet openings (4), are either merging into the end of the deflection radius (r) or into the straight line region (3.G) and in an angle ($\alpha$) to the respective pressurized water-discharge outlet openings (4).

19 Claims, 5 Drawing Sheets

HYDRODYNAMIC TOOL FOR CLEANING PIPES AND CHANNELS

CROSS-REFERENCE TO RELATED APPLICATIONS

This application is a continuation-in-part application of another international application filed under the Patent Cooperation Treaty on Nov. 8, 1996, bearing Application No. PCT/DE96/02153, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a hydrodynamic tool for the cleaning of pipes and channels with a connector for a water hose as a pressurized water-entry inlet opening and pressurized water-discharge outlet openings on the side of the water connection. These tools are formed as flow-through parts and can for example be provided as channel cleaning nozzles or bottom floor cleaners.

2. Brief Description of the Background of the Invention Including Prior Art

Numerous channel-cleaning nozzles are known, which exhibit a water connector providing a pressurized water-entry inlet opening and pressurized water recoil openings, directed rearwardly and connected to the pressurized water-entry inlet opening. The nozzle experiences an advance motion force in the pipe or channel based on the recoil force of the water. In order to achieve a favorable degree of effectiveness of the energy translation, the pressure loss is to be kept as low as possible along the flow.

The following conditions are to be assured:

avoiding of sharp-edged and sudden transitions;

a deflection radiuses to be formed as large as possible;

rounding of the chamfers and bevels;

avoiding of the impact of the flow on surfaces;

a diameter of the guide channel as large as possible;

an optimum conditions between flow speed and rate of flow of the pressurized water;

a low wall roughness ($R_z$<10 micrometers that corresponds to a microprocessed surface).

The degree of effectiveness and the cleaning power of the flow-through part is decisively increased and, simultaneously, the energy and water use is decreased only when these conditions are maintained.

A sewer cleaning chemical dispensing nozzle is taught in U.S. Pat. No. 3,656,694 to Kirschke. Rearward and forward jets are provided for propulsion, cleaning and chemical fumigant dispensing.

A hydraulically already somewhat improved nozzle is taught in the printed patent document WO 85/05295. Here, the connection channels between the pressurized water-entry inlet opening and the pressurized water recoil opening exhibit a relatively large radius. Such a nozzle is shown in FIG. 2 of the reference, which nozzle exhibits a conical water subdivider in the center in the region of the hose connector, wherein the radius joins at the conical-shaped water subdivider. The hollow space in the nozzle expands at a relatively sharp angle from the hose connector such that a ring-shaped impact face is formed in the direction of the pressurized water recoil openings. The discharge openings lead from the impact face in the hollow space outwardly over a discharge deflection angle. Nozzles are inserted into the discharge openings, wherein the nozzles exhibit a conical expansion of the inner diameter in a direction toward the hollow space. Based on the impact of the liquid stream onto the impact face, there is generated an unsteady and noncontinuous cross-section decrease according to hydrodynamic principles, which cross-section decreases already substantially decreases effectiveness. The pressure resistance and the form drag resistance of the impact plate are present in addition, which impedances result in a further substantial decrease of effectiveness, wherein the largest drag coefficient of a circular plate is to be employed in the present case.

Based on this unfavorable hydraulic construction, the axial pressure component of the exiting water beam is weakened and thus the cleaning effect is decreased.

So-called floor cleaners operate according to a similar principle as the channel cleaning nozzles. The floor cleaners comprise, according to German printed patent documents DE 32 37 583 A1 and DE 35 02 916 A1, an open base construction in the kind of a slider with runner-shaped or skid-shaped elements disposed parallel to each other on two sides of the slider. The backflow openings are inclined such that they are directed to the base of the channel. Roll balls secure the floor cleaner against a turning over.

According to the German patent DE GM 93 08 910.4, there is described a channel cleaning apparatus in the shape of a floor cleaner, which exhibits a closed and compact outer construction. The one-sided rounded surface facilitates an automatic restoring of an upright position. A disadvantage of the floor cleaner is the hydraulically unfavorable water guide channeling and the therewith associated efficiency limitations.

German Patent DE 195 16 780 C1 teaches a hydrodynamic nozzle for the cleaning of tubes and channels. A distribution chamber is disposed following to the pressurized water entry opening and pressurized water outlet openings are through channels to the distribution chamber.

SUMMARY OF THE INVENTION

1. Purposes of the Invention

It is an object of the invention to develop a hydrodynamic tool for the cleaning of pipes and channels, which assures a highest possible degree of effectiveness and a maximum cleaning capacity while employing a minimum of energy, which hydrodynamic tool can be varied in its weight according to the field of application, and which hydrodynamic tool guarantees a long service life.

It is another object of the present invention to produce a hydrodynamic tool, which exhibits a stable motion and a superb advance force and cleaning capability.

It is yet a further object of the present invention to furnish full use of the energy available from pressurized water to deliver an advance motion of the hydrodynamic tool and to deliver impact forces of beams of pressurized water effecting cleaning.

These and other objects and advantages of the present invention will become evident from the description which follows.

2. Brief Description of the Invention

According to the present invention there is provided for a hydrodynamic tool for the cleaning of pipes and channels. A tool frame has a front side and a rear side. A pressurized water-entry inlet opening is disposed at the rear side of the tool frame and furnishes a connection for a water hose. Pressurized water-discharge outlet openings are disposed at the rear side of the tool frame and furnish a connection for discharge nozzles. The discharge nozzles are screwable into the pressurized water-discharge outlet openings. Water guide channels in the shape of channels have a circular cross-section. The pressurized water-entry inlet opening is connected to the pressurized water-discharge outlet openings through respective water guide channels. The water guide channels partially converge into one another. At least two of the water guide channels rest with an innermost point of a rearwardly disposed diameter at a center point on an axis of the tool frame and with an outermost point of said diameter at an outer diameter at the front end of the pressurized water-entry inlet opening. A distance between a frontmost saddle point of an inner wall of a respective water guide channel and an opposite inner wall point of the water guide channel, disposed along an axially parallel straight line, is smaller than a thickness of a wall between the pressurized water-entry inlet opening and a respective pressurized water-discharge outlet opening. The water guide channels, corresponding to the respective ones of the pressurized water-discharge outlet openings, are merging into the respective pressurized water-discharge outlet openings. Unsteady cross-sectional changes of the cross-section of the water guide channels in a direction toward the discharge nozzle are absent.

The diameter of the water guide channel near its connection to the discharge nozzle can be larger than 0.25 times the narrowest diameter of the pressurized water-entry inlet opening. The thickness of the wall between the pressurized water-entry inlet opening and a respective pressurized water-discharge outlet opening can be larger than the narrowest diameter of the water guide channel. The water guide channels and the respective pressurized water-discharge outlet openings merge with substantially tangentially disposed surfaces.

The pressurized water-entry inlet opening and a rearmost saddle point of the inner wall of respective ones of the water guide channels can merge tangentially.

The water guide channels can narrow in their cross-section up to a cross-section in a connection region to the pressurized water-discharge outlet openings.

A decrease of the diameter of one of the water guide channels in an area of a connection to the pressurized water-inlet opening to a smaller diameter can end in a region where a curvature of the water guide channel ends.

A hollow chamber can have an opening and be disposed in the tool frame. The hollow chamber can be adapted to carry ballast material. A cover can be adapted to close the opening of the hollow chamber.

The opening can be formed by a borehole. The cover can be formed by a recessable closure screw.

The hollow chamber can be filled with a ballast material for increasing a weight of the tool. The cover can be formed by a closure stopper.

The ballast material can be furnished by a member selected of the group consisting of lead granulate, sand, water or mixtures thereof.

The tool frame can be formed as a casting. The material of the casting can be a stainless steel casting alloy.

The tool frame can be formed as a microcast part for assuring low wall roughnesses of the water guide channels.

The hydrodynamic tools are formed as flow-through parts and exhibit a pressurized water-entry inlet opening, which is connected with water guide channels to the pressurized water-discharge outlet openings.

The water guide channels, starting from the hose connection (pressurized water-entry inlet opening) to the pressurized water-discharge outlet openings, are formed in a single step and without a change of direction and exhibit a largest possible radius. The direction of curvature of the radius of the water guide channels is in this case inclined toward a final direction disposed substantially opposite to the inlet direction of the pressurized water-entry inlet opening. The water guide channels join slidingly to the pressurized water-entry inlet opening and gradually merge into each other in this connection region. Each water guide channel exhibits a circular cross-section and begins such at the pressurized water-entry inlet opening that the water guide channel merges with its innermost point of its diameter at the center point and with its outermost point of its diameter at the outer diameter of the pressurized water-entry inlet opening. Thereby a cone-shaped water subdivider is formed in the region of transition from the pressurized water-entry inlet opening to the water guide channels. The cone-shaped water subdivider exhibits a segment-shaped subdivision based on the connection of the water guide channels according to the present invention and based on the jacket surface of the water guide channels. The segments exhibit thereby in their base the radius of the water guide channels. In case of a pressurized water-entry inlet opening with a relatively large diameter of the hose connection, the diameter of the pressurized water-entry inlet opening tapers and narrows up to the position at which the water guide channels are connected. The narrowing and tapering is thereby preferably cone-shaped or funnel-shaped. The water guide channels can exhibit an enlarged diameter in their connection region at the pressurized water-entry inlet opening. The enlarged diameter tapers and narrows up to about the lowest point of the radius of curvature to that diameter, which the water guide channel then exhibits continuously up to the pressurized water-entry inlet opening. Overall, a continuous funnel-shaped feed from the pressurized water-entry inlet opening to the respective water guide channel and the pressurized water-discharge outlet opening is thereby generated. The pressurized water-discharge outlet openings are inclined at a deflection angle $\alpha$ relative to the longitudinal axis of the hydrodynamic tool. Furthermore, a thread is furnished in the pressurized water-discharge outlet opening for screwing in recoil beam nozzles. If the recoil beam nozzles exhibit a screw head and recesses, the recesses are furnished for the recessed positioning of the head in the pressurized water-discharge outlet openings. Depending on how far the pressurized water-discharge outlet openings protrude into the tool body according to the deflection angle of the thread diameter and the recess, the water guide channels either join with the end of the radius into the pressurized water-discharge outlet opening or the water guide channels lead from the end of the radius along a linear region and at the angle $\alpha$ to the pressurized water-discharge outlet openings. The water guide channels are thereby merged to the pressurized water-discharge outlet openings such that no unsteady and nonuniform cross-sectional changes are formed after the discharge nozzles are screwed in. The linear region of the water guide channel, or, respectively, the pressurized water-discharge outlet opening adjoins substantially tangentially to the radius of the water guide channels.

In addition to the pressurized water-entry inlet opening, the water guide channels and the pressurized water-discharge outlet openings, a hollow space for the filling in of ballast material can additionally be provided in the tool. This hollow space for the filling in of ballast material is furnished with a closure possibility preferably in the shape of a borehole with a closure stopper, wherein in particular the closure stopper is provided with a thread. It is thereby possible to vary the weight of the hydrodynamic tool corresponding to the pump capacity.

The ballast space is in this case disposed in front of the water guide channel as seen in the motion direction. The ballast space can be filled with a ballast material according to need, wherein preferably lead granulate, sand, water or a sand-water mixture are employed.

The hydrodynamic tools are preferably formed as castings since their inner structure is technologically advantageously manufactured by casting. The core of the casting is thereby formed in the future geometry of the pressurized water-entry inlet opening of the water guide channels and of the pressurized water-discharge outlet openings. If an additional ballast space is required, then a further core is furnished in the casting mold for this purpose. Roughnesses of the wall of less than 10 micrometers for minimizing the frictional values of the pipe are assured, for example, by the application of a microcasting process.

Preferably a stainless casting alloy is employed as a material for the hydrodynamic tools. A corrosion protection and rust protection in connection with other casting alloys can be achieved with a rust-resistant paint or other types of coating, such as, for example, by galvanizing.

The impact losses and turbulent flows are reduced nearly to zero based on the first-time complete elimination of unsteady and nonuniform cross-sectional changes as well as form drag resistances with the novel and elegant interior form of the tools, the effectiveness is substantially increased in comparison to conventional hydrodynamic tools in the shape of channel cleaning nozzles or floor cleaners of a similar construction, and the flow-technical behavior is decisively improved.

The water is led through channels (tubing) in a large radius to the pressurized water-discharge outlet openings. Thus, the turbulences are minimized and the beams remain bundled for a longer time, whereby the cleaning capability is substantially improved. In addition, the water deflection decreases the pressure losses. It is a disadvantage that the water deflection is performed through tubing, which tubing exhibits an insufficient service life.

The following advantages are obtained:

decrease of energy and water use;

increase of the cleaning capacity;

long service life;

variable weight.

For the first time a tool for the hydrodynamic cleaning of pipes and channels is created according to the construction of the present invention, which assures all the above recited advantages.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
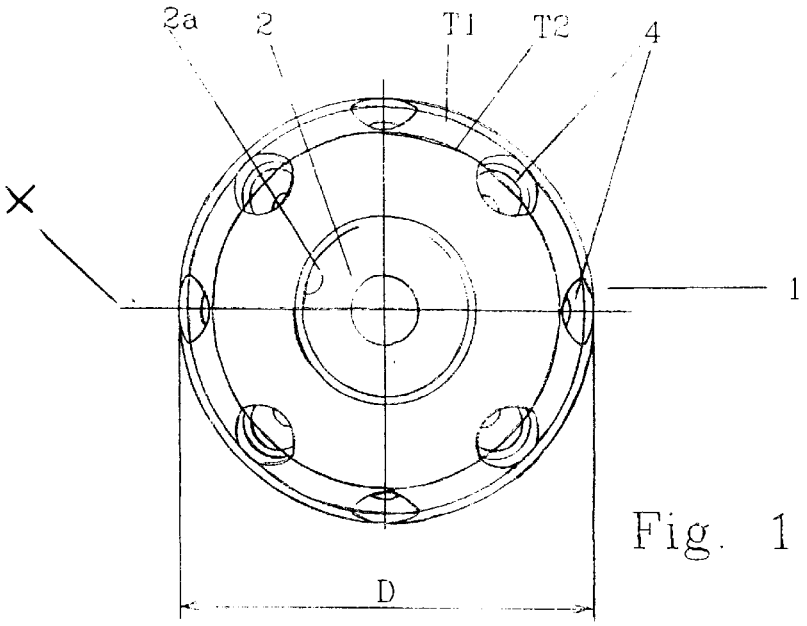
FIG. 1 is a top plan view of a channel cleaning nozzle.

According to the present invention, there is provided for a hydrodynamic tool for the cleaning of pipes and channels with a connection for a water hose as a pressurized water-entry inlet opening and pressurized water-discharge outlet openings on the side of the water connection. The pressurized water-entry inlet opening is connected to the pressurized water-discharge outlet openings with water guide channels in the shape of channels having a circular cross-section. Discharge nozzles are screwable into the pressurized water-discharge outlet openings. The water guide channels 3 exhibit a largest possible deflection radius r, continuously connect to the pressurized water-entry inlet opening 2, and partially converge into one another. At least two water guide channels 3 rest with the innermost point of their diameter $d_{W1}$ at the center point M and with the outermost point of their diameter $d_{W1}$ at the outer diameter $d_E$ of the pressurized water-entry inlet opening 2. The direction of curvature of the deflection radius r is opposite to the pressurized water-entry inlet opening 2. The water guide channels 3 corresponding to the arrangement of the pressurized water-discharge outlet openings 4 are either merging with the end of their deflection radius r or with a linear region 3.G and at an angle $\alpha$ over into the respective pressurized water-discharge outlet openings 4. Unsteady cross-sectional changes toward the discharge nozzle 5 are avoided.

The linear region 3.G of the water guide channels 3 or, respectively, the pressurized water-discharge outlet openings 4 can merge substantially tangentially to the deflection radius r. The pressurized water-entry inlet opening 2 in case a hose connection 2*a* is larger than $2\times d_{W1}$, can narrow up to the diameter $2\times d_{W1}$ preferably in a funnel shape.

The water guide channels 3 can narrow in their diameter $d_{W1}$ up to a diameter $d_{W2}$ in the connection region of the pressurized water-discharge outlet openings 4. The decrease of the diameter $d_{W1}$ to the diameter $d_{W2}$ can end in the region of the position of the deflection radius r disposed the farthest in the direction of flow motion.

A hollow chamber with a closure possibility can be disposed in the tool. The closure possibility can comprise a borehole and a member selected of the group consisting of a recessable closure screw and a closure stopper.

The hollow chamber can be filled with a ballast material for increasing the tool weight. The ballast material can be a member selected of the group consisting of lead granulate, sand, water and mixtures thereof.

The hydrodynamic tool can be formed as a casting. A stainless steel casting alloy can be employed as a casting material of the tool.

The hydrodynamic tool can be formed as a microcast part for assuring low wall roughnesses of the water guide channels.

Figure 2:
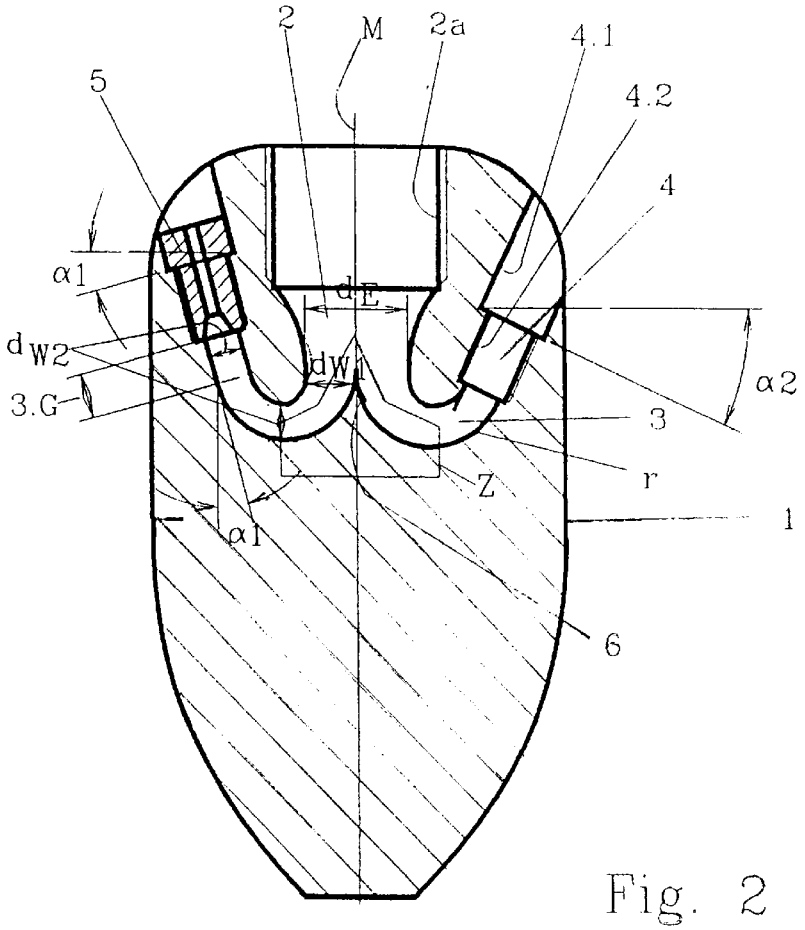
FIG. 2 is a sectional view of the channel cleaning nozzle along a section line X according to FIG. 1.

A view of a channel cleaning nozzle 1 with a pressurized water-entry inlet opening 2, which is connected with eight water guide channels 3 to eight pressurized water-discharge outlet openings 4, is illustrated in FIGS. 1 and 2. A top plan view onto the nozzle body is shown in FIG. 1 and a longitudinal sectional view along a section line X according to FIG. 1 is shown in FIG. 2. The eight water guide channels 3 are continuously merged at the pressurized water-entry inlet opening 2 with a hose connection 2*a*, wherein the water guide channels 3 form the connection to the pressurized water-discharge outlet openings 4. The pressurized water-discharge outlet openings 4 exhibit alternatingly different deflection angles $\alpha_1$ and $\alpha_1$ and they rest on different reference circle lines $T_1$ and $T_2$. In this context, the pressurized water-discharge outlet openings 4, which are disposed on the inner reference circle line $T_1$, have a smaller deflection angle $\alpha_1$ than the pressurized water-discharge outlet openings 4 disposed on the outer reference circle line $T_2$. The larger the angle of inclination and thus the deflection angle $\alpha$ is selected, the farther away the reference circle lines $T_1$ and $T_2$ are disposed in the direction to the outer diameter D of the channel cleaning nozzle 1. The number of the pressurized water-discharge outlet openings 4 is determined according to the desired required profile, wherein the deflection angles $\alpha$ of the pressurized water-discharge outlet openings can all be the same such that the pressurized water discharge outlet openings 4 are disposed on a common reference circle line. Usually six or more pressurized water-discharge outlet openings are selected.

The deflection angle $\alpha$ can amount to between 5 and 40 degrees. The radius r of the water guide channels is to be selected depending on the nozzle dimension (length and diameter) and the required deflection angle $\alpha$.

The narrowest open diameter of the pressurized water-entry inlet opening 2 can be less than one third of the total width of the channel cleaning nozzle 1 and is preferably less than two seventh of the total width of the channel cleaning nozzle 1 and can be for example one quarter of the total width of the channel cleaning nozzle 1 or less than one fifth of the total width of the channel cleaning nozzle 1. The guide channel 3 can have a tubular shape with a smooth surface. The tube can decrease in open diameter when going from the end of the guide channel, disposed near the pressurized water-entry inlet opening 2, toward the pressurized water-discharge outlet opening 4 or can exhibit a constant cross-sectional size. The decrease in cross-section can be up to about 60 percent and is preferably less than 50 percent. The cross-section of the guide channel 3 is preferably of circular shape. The inner radius of curvature of the guide channel 3 in a section through the middle plane of the guide channel 3 is preferably more than one quarter of the narrowest open diameter of the pressurized water-entry inlet opening 2 and more preferably more than one half of the narrowest open diameter of the pressurized water-entry inlet opening 2. Both the inner radius of curvature of the guide channel 3 and the outer radius of curvature of the guide channel 3 in a section through the middle plane of the guide channel 3 is a steady function relative to the length of the guide channel 3 in order to provide a substantially turbulence-free flow of the pressurized water through the guide channel 3. The pressurized water-entry inlet opening 2 can narrow from the entrance area of the pressurized water to the junction with the guide channels 3 either linearly or diminishingly by a total amount of from about 20 to 50 percent of the passage diameter and preferably from about 30 to 40 percent of the passage diameter of the pressurized water-entry inlet opening 2. The guide channels 3 are preferably disposed on circles around the pressurized water-entry inlet opening 2. This balances any reaction of the channel cleaning nozzle 1 in case of a change in pressure of the driving pressurized water. The thickness of the wall between the pressurized water-entry inlet opening 2 and a respective pressurized water-discharge outlet opening 4 is larger than the narrowest diameter of the water guide channel 3. The distance between the frontmost saddle point of the inner wall of a water guide channel 3 and an opposite wall point of the water guide channel 3 disposed along an axially parallel straight line is smaller than the thickness of the wall between the pressurized water-entry inlet opening 2 and a respective pressurized water-discharge outlet opening 4. This condition allows for the smooth and non-turbulent guiding of the pressurized water through the water guide channel 3. The diameter of the water guide channel 3 near its connection to the discharge nozzle 5 is larger than 0.25 times the narrowest diameter of the pressurized water-entry inlet opening 2 and preferably larger than 0.3 times the narrowest diameter of the pressurized water-entry inlet opening 2, and more preferably larger than 0.4 times the narrowest diameter of the pressurized water-entry inlet opening 2.

Since the pressurized water-entry inlet opening 2 has a relatively large thread for the hose connection 2*a* according to this embodiment, the diameter of the pressurized water-entry inlet opening 2 decreases conically to the diameter $d_E$ up to the water guide channels 3. The water guide channels 3 have a largest possible deflection radius r and pass into the pressurized water-entry inlet opening 2 such that all water guide channels 3 rest with the innermost point of their diameter $d_{W1}$ on the nozzle axis A and in the center line point M and with the outermost point of their diameter $d_{W1}$ at the diameter $d_E$ of the pressurized water-entry inlet opening 2 ($d_E=2\times d_{W1}$). Since the water guide channels 3 have to exhibit a defined diameter $d_{W2}$ in the region of the transition to the pressurized water-discharge outlet opening 4, and since the small diameter $d_E$ of the pressurized water-entry inlet opening 2 is larger than $2\times d_{W2}$, the water guide channels 3 have to be enlarged in their connection region at the pressurized water-entry inlet opening 2 in their diameter $d_{W2}$ to the diameter $d_{W1}$ such that this diameter $d_{W2}$ amounts to $d_E/2$. The funnelshaped diameter decrease of the pressurized water-entry inlet opening 2 and the thereto adjoining taper of the diameter $d_{W1}$ to the diameter $d_{W2}$ of the water guide channels 3 is to be dimensioned such that a continuous and steady cross-sectional decrease is formed, whereby turbulences of the liquid beam are avoided.

The pressurized water-discharge outlet openings 4 with the larger deflection angle $\alpha_2$ protrude further into the channel cleaning nozzle 1 than the pressurized water-discharge outlet openings 4 with the smaller deflection angle $\alpha_1$. Thereby, the water guide channels 3 pass into the pressurized water-discharge outlet openings 4 with the larger deflection angle $\alpha_2$ in their radius r and lead to the pressurized water-discharge outlet openings 4 with the smaller deflection angle $\alpha_1$ from the end of the radius r in a linear region 3.G and at the angle $\alpha_1$. The linear region 3.G and the pressurized water-discharge outlet openings 4 with the deflection angles $\alpha_2$ merge tangentially to the radius r of the water guide channels 3. The pressurized water-discharge outlet openings 4 exhibit advantageously recesses 4.1 and a thread 4.2 for screwing in discharge nozzles 5. A pressurized water-discharge outlet opening 4 with discharge nozzles 5 and a pressurized water-discharge outlet opening 4 without discharge nozzles 5 is illustrated in the cross-sectional view. The water guide channels 3 merge to the pressurized water-discharge outlet openings 4 such that no unsteady cross-sectional changes are formed, in particular after screwing in the discharge nozzles.

Figure 2A:
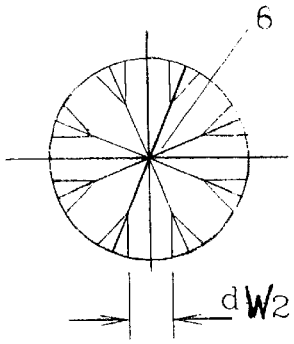
FIG. 2*a* is a sectional partial view (a top plan view) of a distribution cone along a section line Z according to FIG. 2.
Figure 2B:
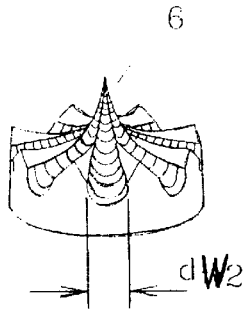
FIG. 2*b* is a perspective view of the distribution cone according to FIG. 2*a;*
Figure 3:
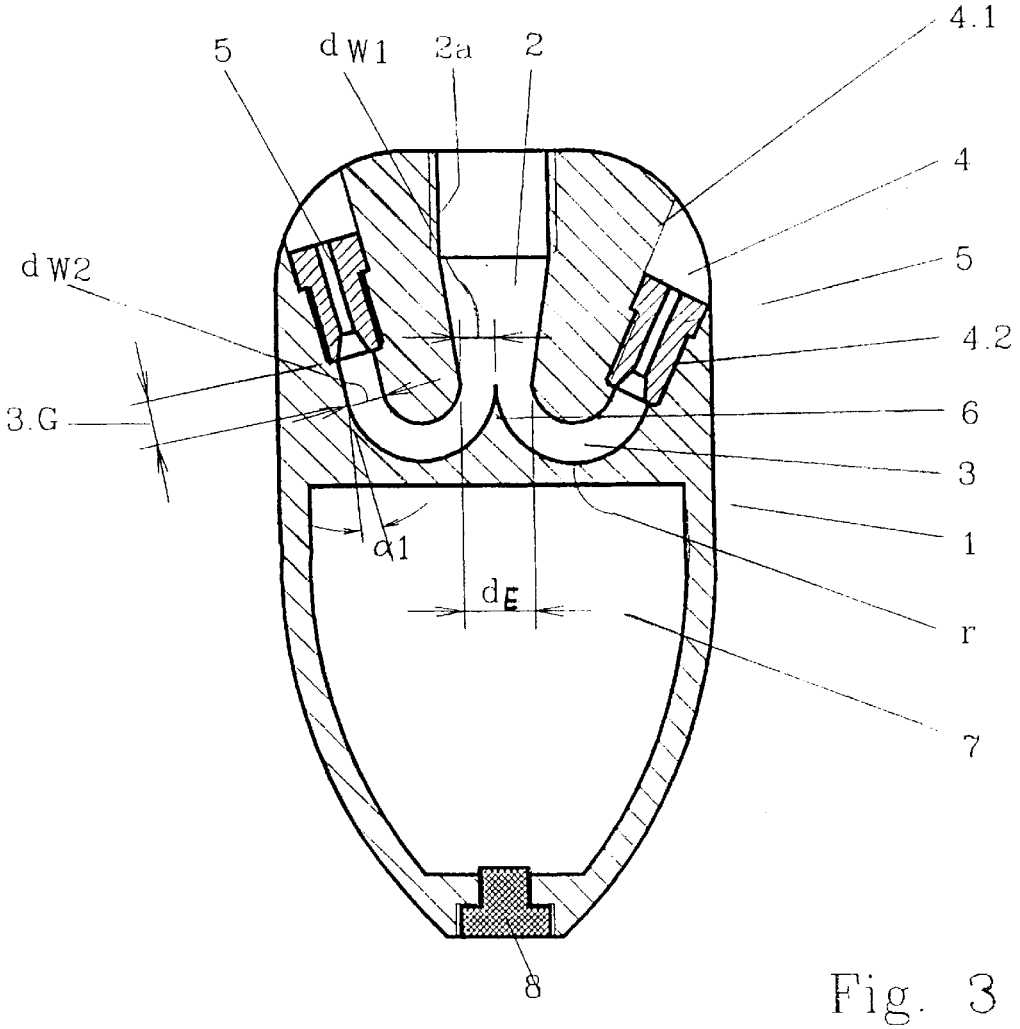
FIG. 3 is a sectional view of the channel cleaning nozzle exhibiting in addition a hollow space.
Figure 4:
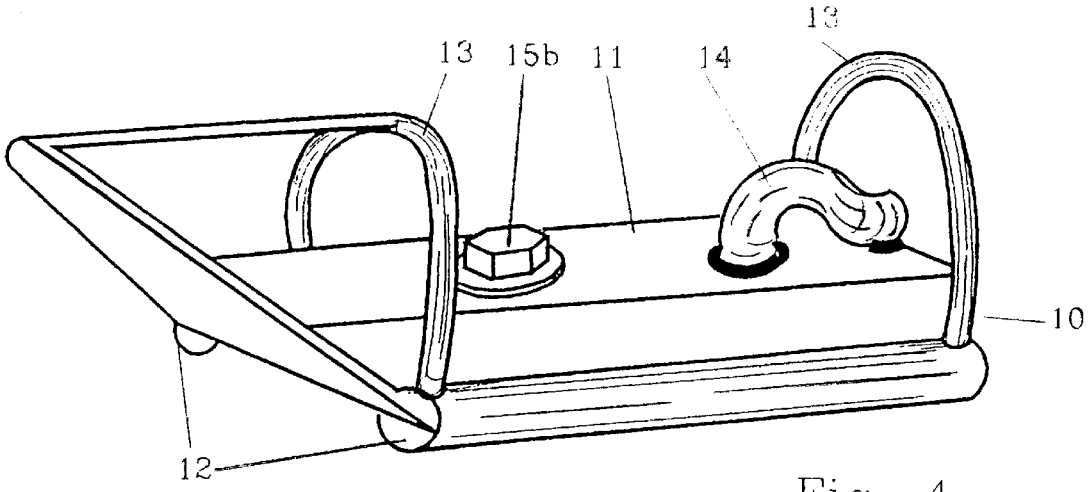
FIG. 4 is a perspective view of a floor cleaner.
Figure 5:
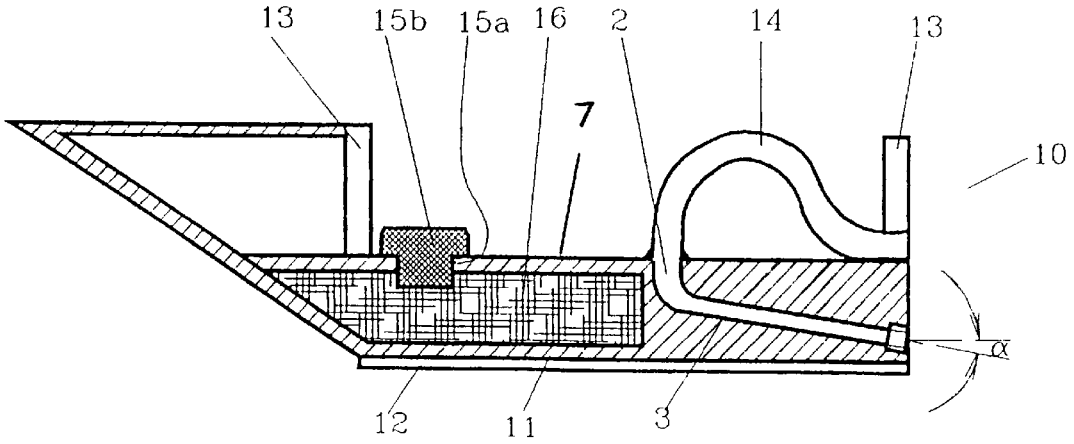
FIG. 5 is a longitudinal sectional view of the floor cleaner according to FIG. 4.

Since the water guide channels 3 start in the center of the pressurized water-entry inlet opening 2, since the water guide channels 3 join there into each other, and since the water guide channels 3 lead toward the outside in the radius r, which radius r is directed with its direction of curvature opposite to the pressurized water-entry inlet opening 2, a conical water subdivider 6 with a segment shaped subdivision is formed in the connection region of the water guide channels 3 to the pressurized water-entry inlet opening 2. This water subdivider 6 is illustrated in FIG. 2*a* in the sectional partial and top plan view according to FIG. 2. A perspective view is shown in FIG. 2*b*. A further advantage of the invention comprises the disposition of in addition a hollow space 7 in the channel cleaning nozzle 1 shown in FIG. 3. This hollow space 7 is disposed thereby in direction of motion in front of the water guide channels 3 and is closed at its end disposed opposite to the pressurized water-entry inlet opening 2 with a closure screw 8 (illustrated schematically). Lead granulate, sand, water or sand-water mixture can be filled into this hollow space. The closure screw 8 can be disposed in the front area of the cleaning nozzle (FIG. 3) or alternatively on top of the hollow chamber 7 (FIGS. 4 and 5).

The hollow space or hollow chamber 7 assumes more than 30 percent in projection of the space covered by the channel cleaning nozzle 1 and preferably more than 40 percent in projection of the space covered by the channel cleaning nozzle 1, and more preferably more than 50 percent in projection of the space covered by the channel cleaning nozzle 1. The hollow space 7 is bordered by the front cover of the channel cleaning nozzle 1 and by the front sides of the guide channels 3. The front face and the rear face of the hollow space are preferably planar disposed perpendicular to the advance direction of the channel cleaning nozzle 1. The front section of the nozzle and the front section of the hollow space 7 can have a shape like a rocket tip substantially between a parabolic and elliptical head. The tip in the front middle is preferably removed and substituted by a flat section having a diameter of from about 0.15 to 0.4 times the maximum width of the channel cleaning nozzle 1 and preferably having a diameter of from about 0.2 to 0.3 times the maximum width of the channel cleaning nozzle 1. The length of the axial extension of the hollow space 7 in the channel cleaning nozzle 1 can be from about 0.3 to 0.6 times the full length of the channel cleaning nozzle 1 and is preferably from about 0.4 to 0.5 times the full length of the channel cleaning nozzle 1.

By filling the hollow space 7 with a material furnishing weight, it is for the first time possible to vary the weight of the channel cleaning nozzle 1 according to the pump capacity. The channel cleaning nozzle 1, shown in FIG. 3, exhibits a relatively small pressurized water-entry inlet opening 2 with the hose connection 2*a* in the shape of a thread and narrows and tapers also up to the starting point of the water guide channels 3. The water guide channels 3 exhibit in the region of the connection to the pressurized water-entry inlet opening 2 no expanded diameter $d_{W1}$, but exhibit over the complete length the diameter $d_{W2}$ ($d_{W1}=2d_{W2}$).

Continuing the idea of the novel structure of the channel cleaning nozzle 1, there can be furnished also other tools for a hydrodynamic cleaning of pipes and channels as castings with the novel water guide channel and, if required, with a hollow space for changing weight in addition.

A floor cleaner 10 is shown in a perspective view in FIG. 4.

The base body 11 of the floor cleaner 10 exhibits on two sides skid-shaped elements 12 disposed parallel to each other. The pressurized water-entry inlet opening 2, the water guide channels 3, and the pressurized water-discharge outlet openings 4 are disposed in the base body 11.

The pressurized water-entry inlet opening 2 is connected via the water guide channels 3 to the pressurized water-discharge outlet openings 4. The water guide channels 3 merge as in the case of the channel cleaning nozzle 1 continuously into the pressurized water-entry inlet opening 2 and blend in this region in part into each other.

Two roll bars 13 assure an automatic restoring of the upright position of the floor cleaner 10 in case the floor cleaner 10 flips over.

A tubular, bent hose connection 14 leads from the pressurized water-entry inlet opening 2 in the base body 11 to the end of the floor cleaner 10, where the pressurized water-discharge outlet openings 4 are disposed at the end of the floor cleaner 10. This hose connection 14 is connected in the region of the pressurized water-entry inlet opening 2 to the base body 11 in a disengageable or non-disengageable way. The disengageable connection can be assured by a coupling nut, not illustrated, which coupling nut is screwed to the base body 11. The non-disengageable connection is preferably performed by welding, wherein the hose connection 14 is welded with its other end to the base body 11.

Figure 4A:
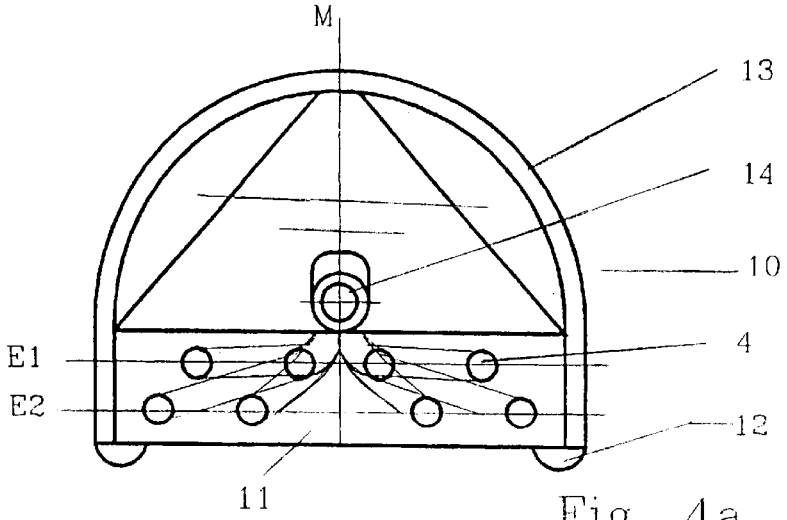
FIG. 4*a* is a view of the floor cleaner from the direction of a hose connection.

The pressurized water-discharge outlet openings 4 are not disposed on the reference circles as in the case of the channel cleaning nozzle 1, but are disposed in rows and in two planes E1 and E2 (compare FIG. 4*a*). Four pressurized water-discharge outlet openings are furnished in each plane E1 and E2. In this case, the pressurized water-entry inlet openings 2 of the planes E1 and E2 are disposed staggered relative to each other. The deflection angles $\alpha$ are directed in each case in the direction toward the floor and are simultaneously directed outwardly as seen from the vertical center line M. Depending on the requirement profile, the pressurized water-discharge outlet openings can be varied in quantity.

A longitudinal section view of the floor cleaner 10 is illustrated in FIG. 5.

In this context a hollow space 7 is furnished, as seen in the direction of motion, in front of the water guide channels 3. The hollow space 7 is opened toward the top through a borehole 15*a*, wherein this borehole 15*a* can preferably be closed with a closure stopper 15*b*. This hollow space 7 can also be filled, as described above, with ballast material 16.

The embodiment of FIGS. 4, 4*a*, and 5 can be constructed such that it is capable of moving along a liquid-gas interface. All pressurized water discharge tubes can be directed downwardly under an angle of from about 10 to 40 degrees and preferably of an angle from 20 to 30 degrees. The exiting beams of pressurized water can be each collimated by a straight section of the pressurized water-discharge outlet opening 4 extending over a length of from about 0.15 to 0.4 and preferably from about 0.2 to 0.3 times the total length of the floor cleaner 10. The hose connection 14 can be disposed above the pressurized water-discharge outlet channels 4 such that the deflection of the pressurized water is performed in a vertical plane.

A face can be furnished at the front side of the floor cleaner 10 to allow the front tip of the floor cleaner 10 to float up when the floor cleaner 10 is advanced. The upper side of the floor cleaner 10 is furnished in FIG. 5 with a closure stopper 15*b* for retaining weight-giving materials in the hollow space 7 of the floor cleaner 10. The weight-giving materials can be furnished in such quantity as to stabilize the position of the cleaner and/or to prevent a capsizing of the floor cleaner 10. The floor of the floor cleaner 10 with the skid-shaped elements 12 can be substantially flat.

The manufacture of the channel cleaning nozzle 1 and of the base body 11 of the floor cleaner 10 is preferably performed by casting since this method represents the technologically most advantageous variant for a production of the tool. The rust protection can thereby be furnished by surface protection such as, for example, a rust-resistant paint or by galvanizing or by the application of a stainless steel casting alloy. Based on the application of a microcast process, it is possible to reduce the wall roughness to less than 10 micrometers such that the tube friction coefficient is minimized.

Figure 6:
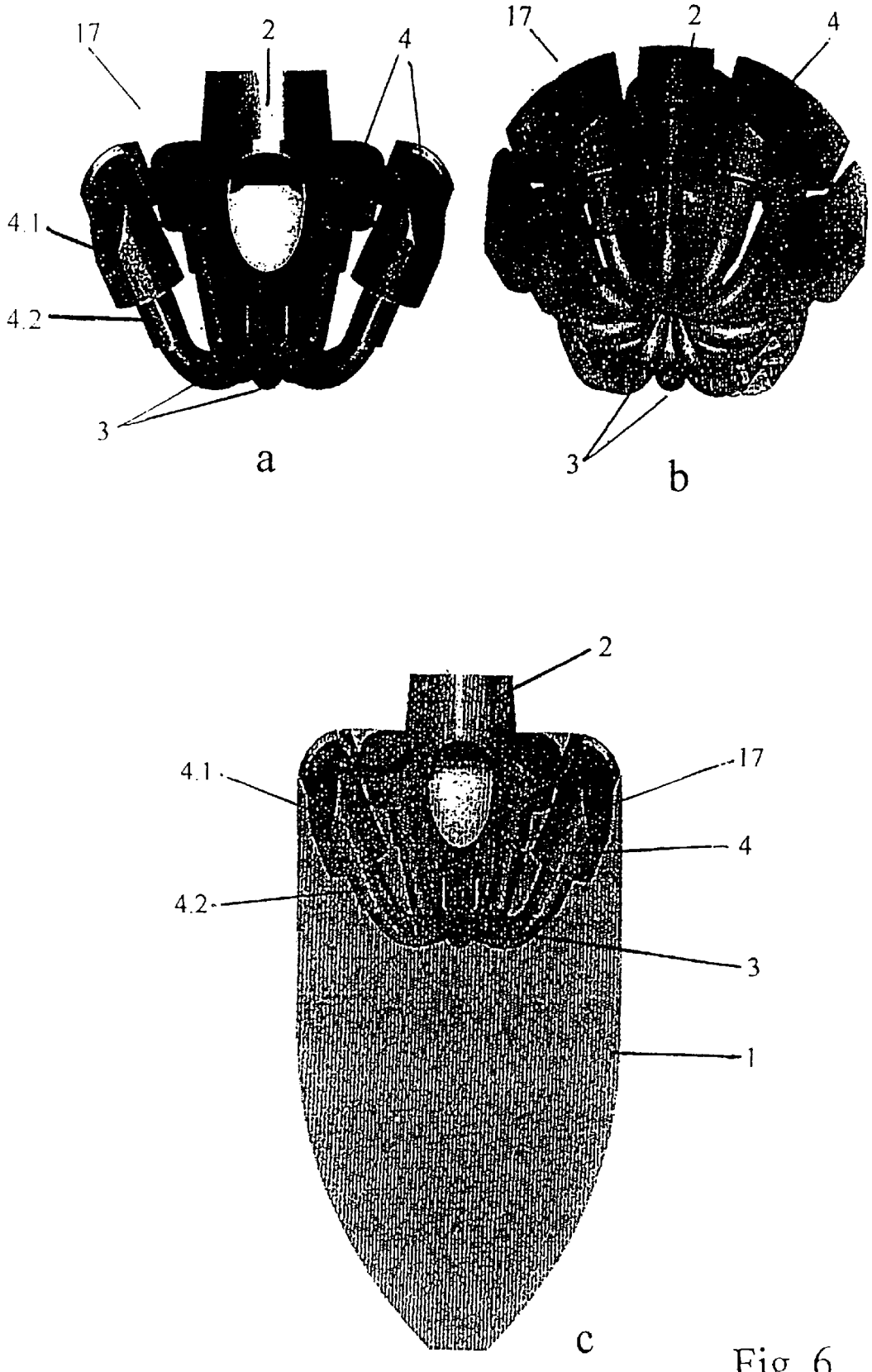
FIG. 6 is a perspective view of a core for casting of the channel cleaning nozzle.

The core 17 of a casting mold for the water guide channel of the channel cleaning nozzle 1 is illustrated in FIG. 6. The pressurized water-discharge outlet openings 4 and the water guide channels 3 are disposed on a circle, the water guide channels 3 converge in a star shape in the center of the pressurized water-entry inlet opening 2 and continue smoothly into the water-entry inlet opening 2, wherein the water guide channels 3 in part converge into each other. The water guide channels 3 join to the pressurized water-entry inlet opening 2 in the deflection radius r, wherein the direction of curvature of the deflection radius r and its size are selected such that there is fluid-dynamically generated a smallest possible resistance.

Figure 7:
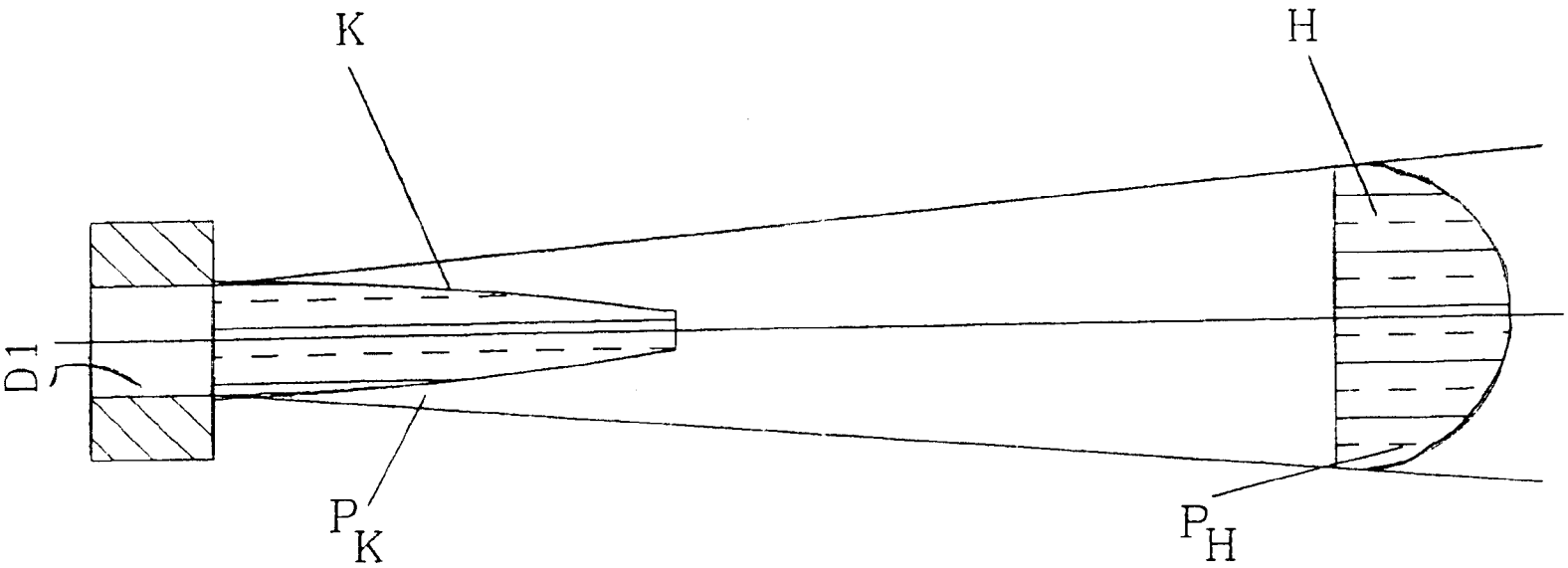
FIG. 7 is the course of the axial pressure PK in the beam of liquid.

The core in the case of floor cleaners is formed analogously, however, the regions for the pressurized water-entry inlet opening 2, the water guide channels 3, and the pressurized water-discharge outlet openings 4 are disposed such relative to each other as is required by the future structure of the base body (the pressurized water-discharge outlet openings are not disposed in a circle, but in several planes, different deflection angles, etc.). The continuous flow region is increased or, respectively, the axial pressure PK in the region of the core zone K and the axial pressure H in the main region H is increased based on the connection of the water guide channels 3 to the pressurized water-entry inlet opening 2 according to the invention, based on the large deflection radius r of the water guide channels 3, and based on the smooth transition to the pressurized water-discharge outlet openings 4 (FIG. 7).

The cleaning effect of the hydrodynamic tools according to the invention is improved in comparison to conventional channel cleaning nozzles or, respectively, floor cleaners of similar type of construction based on the increase of the axial pressure PK.

It will be understood that each of the elements described above, or two or more together, may also find a useful application in other types of tools differing from the types described above.

While the invention has been illustrated and described as embodied in the context of a hydrodynamic tool for cleaning pipes and channels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydrodynamic tool for cleaning of pipes and channels comprising a tool frame having a front side and having a rear side;

a pressurized water-entry inlet opening disposed at the rear side of the tool frame and furnishing a connection for a water hose;

pressurized water-discharge outlet openings disposed at the rear side of the tool frame and furnishing a connection for discharge nozzles, wherein the discharge nozzles are screwable into the pressurized water-discharge outlet openings;

water guide channels in the shape of channels having a circular cross-section, wherein the pressurized water-entry inlet opening is connected to the pressurized water-discharge outlet openings through respective water guide channels;

wherein the water guide channels partially converge into one another, wherein at least two of the water guide channels rest with an innermost point of a rearwardly disposed diameter at a center point on an axis of the tool frame and with an outermost point of said diameter rests at an outer diameter at the front end of the pressurized water-entry inlet opening;

wherein a distance between a frontmost saddle point of an inner wall of a respective water guide channel and an opposite inner wall point of the water guide channel, disposed along an axially parallel straight line, is smaller than a thickness of a wall between the pressurized water-entry inlet opening and a respective pressurized water-discharge outlet opening;

wherein the water guide channels, corresponding to the respective ones of the pressurized water-discharge outlet openings, are merging into the respective pressurized water-discharge outlet openings, wherein unsteady cross-sectional changes of the cross-section of the water guide channels in a direction toward the discharge nozzle are absent.

2. The hydrodynamic tool according to claim 1, wherein the diameter of the water guide channel near its connection to the discharge nozzle is larger than 0.25 times the narrowest diameter of the pressurized water-entry inlet opening;

wherein the thickness of the wall between the pressurized water-entry inlet opening and a respective pressurized water-discharge outlet opening is larger than the narrowest diameter of the water guide channel;

wherein the water guide channels and the respective pressurized water-discharge outlet openings merge with substantially tangentially disposed surfaces.

3. The hydrodynamic tool according to claim 1, wherein the pressurized water-entry inlet opening and a rearmost saddle point of the inner wall of respective ones of the water guide channels merge tangentially.

4. The hydrodynamic tool according to claim 1, wherein the water guide channels narrow in their cross-section up to a cross-section in a connection region to the pressurized water-discharge outlet openings.

5. The hydrodynamic tool according to claim 1, wherein a decrease of the diameter of one of the water guide channels in an area of a connection to the pressurized water-entry inlet opening to a smaller diameter ends in a region where a curvature of the water guide channel ends.

6. The hydrodynamic tool according to claim 1, further comprising a hollow chamber having an opening and disposed in the tool frame, wherein the hollow chamber is adapted to carry ballast material;

a cover adapted to close the opening of the hollow chamber.

7. The hydrodynamic tool according to claim 6, wherein the opening is formed by a borehole, and wherein the cover is formed by a recessable closure screw.

8. The hydrodynamic tool according to claim 6, wherein the hollow chamber is filled with a ballast material for increasing a weight of the tool, and wherein the cover is formed by a closure stopper.

9. The hydrodynamic tool according to claim 8, wherein the ballast material is furnished by a member selected of the group consisting of lead granulate, sand, water or mixtures thereof.

10. The hydrodynamic tool according to claim 1, wherein the tool frame is formed as a casting.

11. The hydrodynamic tool according to claim 10, wherein the material of the casting is a stainless steel casting alloy.

12. The hydrodynamic tool according to claim 1, wherein the tool frame is formed as a microcast part for assuring low wall roughnesses of the water guide channels.

13. Hydrodynamic tool for cleaning of pipes and channels with a connection for a water hose as a pressurized water-entry inlet opening and pressurized water-discharge outlet openings on a side of the water connection, wherein the pressurized water-entry inlet opening is connected to the pressurized water-discharge outlet openings with water guide channels in the shape of channels having a circular cross-section, and wherein discharge nozzles are screwable into the pressurized water-discharge outlet openings, characterized in that the water guide channels (3) exhibit a largest possible deflection radius (r), continuously connect to the pressurized water-entry inlet opening (2), and partially converge into one another, wherein at least two water guide channels (3) rest with an innermost point of their diameter ($d_{W1}$) at the center point (M) and with an outermost point of their diameter ($d_{W1}$) at an outer diameter ($d_E$) of the pressurized water-entry inlet opening (2), wherein the direction of curvature of the deflection radius (r) is opposite to the pressurized water-entry inlet opening (2), wherein the water guide channels (3) corresponding to the arrangement of the pressurized water-discharge outlet openings (4) are either merging with the end of their deflection radius (r) or with a linear region (3.G) and at an angle ($\alpha$) over into the respective pressurized water-discharge outlet openings (4), wherein unsteady cross-sectional changes toward the discharge nozzle (5) are avoided.

14. The hydrodynamic tool according to claim 13, wherein the linear region (3.G) of the water guide channels (3) or, respectively, the pressurized water-discharge outlet openings (4) merge substantially tangentially to the deflection radius (r);

wherein the pressurized water-entry inlet opening (2) in case a hose connection (2*a*) is larger than $2\times d_{W1}$, narrows up to the diameter $2\times d_{W1}$ preferably in a funnel shape.

15. The hydrodynamic tool according to claim 13, wherein the water guide channels (3) narrow in their diameter ($d_{W1}$) up to a diameter ($d_{W2}$) in a connection region of the pressurized water-discharge outlet openings (4);

wherein the decrease of the diameter ($d_{W1}$) to the diameter ($d_{W2}$) ends in a region of the position of the deflection radius (r) disposed farthest in a direction of flow motion.

16. The hydrodynamic tool according to claim 13, further comprising a hollow chamber with a closure possibility disposed in the tool;

wherein the closure possibility comprises a borehole and a member selected of a group consisting of a recessable closure screw and a closure stopper.

17. The hydrodynamic tool according to claim 16, wherein the hollow chamber is filled with a ballast material for increasing the tool weight;

wherein the ballast material is a member selected of the group consisting of lead granulate, sand, water and mixtures thereof.

18. The hydrodynamic tool according to claim 13, wherein the hydrodynamic tool is formed as a casting;

wherein a stainless steel casting alloy is employed as a casting material of the tool.

19. The hydrodynamic tool according to claim 13, wherein the hydrodynamic tool is formed as a microcast part for assuring low wall roughnesses of the water guide channels.

* * * * *